US005573100A

United States Patent [19]

Vergne et al.

[11] Patent Number: 5,573,100

[45] Date of Patent: Nov. 12, 1996

[54] DEVICE FOR CHECKING METALLIC PIECES, IN PARTICULAR COINS

[75] Inventors: Robert Vergne, Riom; Pascal Flocom, Massy, both of France

[73] Assignee: CSEE-Peage, Paris, France

[21] Appl. No.: 425,366

[22] Filed: Apr. 20, 1995

[30] Foreign Application Priority Data

Apr. 22, 1994 [FR] France ..... 94 04893

[51] Int. Cl.[6] ..... G07D 5/08

[52] U.S. Cl. ..... 194/318; 194/352; 453/3; 453/57

[58] Field of Search ..... 453/3, 12, 13, 453/33, 34, 57; 221/182, 203; 194/318, 352

[56] References Cited

U.S. PATENT DOCUMENTS

| | | | |
|---|---|---|---|
| 3,253,604 | 5/1966 | Read | 453/57 |
| 4,304,247 | 12/1981 | Hasegawa | 221/182 X |
| 4,548,220 | 10/1985 | LeHong et al. | 453/3 |
| 5,195,626 | 3/1993 | LeHong et al. | 453/57 X |

FOREIGN PATENT DOCUMENTS

| | | | |
|---|---|---|---|
| 2147443 | 5/1985 | United Kingdom | 453/57 |

*Primary Examiner*—F. J. Bartuska

*Attorney, Agent, or Firm*—Anthony J. Casella; Gerald E. Hespos

[57] ABSTRACT

Device for checking metallic pieces, in particular coins, characterized in that it includes:

two motorized, integral, concentric disks (3, 4) rotating in a plane that is inclined in relation to the horizontal, namely:

an internal, so-called separating disk (3), onto which the pieces are thrown in loose condition, and which is provided with substantially radial edges (7) for separating the pieces, and an outer, so-called piece-recognition disk (4), the periphery of which is provided with alveoles (8), located in prolongation of the edges (7) of the internal disk (7), for receiving the pieces thus separated, the said pieces being held in the said alveoles (8) by a sliding plate (13) located under the outer disk (4), and by a circular border (12) partially surrounding the said outer disk (4);

a fixed semi-circular barrier (10) disposed at the separation between the inner disk (3) and the outer disk (4) for retaining the pieces on the inner disk (3) in the lower portion thereof, and a piece-recognition device comprising a number of sensors (16) disposed on the path of the alveoles (8) of the outer disk (4).

10 Claims, 8 Drawing Sheets

DEVICE FOR CHECKING METALLIC PIECES, IN PARTICULAR COINS

The present invention relates to a device for checking metallic pieces received loose, more especially intended for coins or tokens, for example for automated toll payment on motorways or in car parks, but which could also be used in other applications, for example for the purpose of sorting bearings or gear wheels.

At the present time, there exist several designs of coin checking devices, in particular in the field of so-called automated toll payment on motorways. Such apparatus are designed with a view to meeting three main requirements:

to separate and check the coins quickly, to ensure that the device for unitary separation of the coins does not adversely affect the detection or checking of these coins and to withstand mechanical stress, particularly abrasion and hammering caused by the dropping of the coins in loose condition.

The known apparatus are generally the result of a compromise between the three demands mentioned above, and they are not, therefore, perfect.

Thus, for example, there are known apparatus in which the separation and checking of the coins are carried out by means of a single non-metallic disk provided with alveoles. Such a disk affords poor resistance to the mechanical stress exerted by the coins, with the result that there is most often a tendency to use it a low speed of rotation in order to attenuate such stress. The coin processing speed is thus thereby reduced.

There are also known apparatus, such as those described, for example, in French patent No. 2 542 475, which use two separate disks, namely a first metallic toothed disk for separating the coins from one another, and a second non-metallic toothed disk for detection purposes. The result is a longer coin processing time.

Finally, there are also known apparatus such as those described, for example, in French patent No. 2 633 079, essentially composed of a single metallic, circular plate with a toothed periphery. Such a metallic plate adversely affects the detection of the coins, which necessitates electronic and computer processing to filter the measurements effected. This results in errors in coin recognition.

Furthermore, in all the aforementioned apparatus, having a toothed or alveole comprising disk, it may happen that two coins are not correctly separated and lodge in the same tooth or in the same alveole, particularly in the case of coins with a diameter smaller than the radius of the largest coin to be processed. This separation defect leads to authentication errors, whatever the computer processing used for checking purposes.

The object of the present invention is thus to overcome all these drawbacks and, to do so, it provides a device for checking metallic pieces which is essentially characterized in that it includes:

two motorized, integral, concentric disks rotating in a plane that is inclined in relation to the horizontal, namely:

an internal, so-called separating disk, onto which the pieces are thrown in loose condition, and which is provided with substantially radial edges for separating the pieces, and an outer, so-called piece-recognition disk, the periphery of which is provided with alveoles, located in prolongation of the edges of the internal disk, for receiving the pieces thus separated, the said pieces being held in the said alveoles by a sliding plate located under the outer disk, and by a circular border partially surrounding the said outer disk;

a fixed semi-circular barrier disposed at the separation between the inner disk and the outer disk for retaining the pieces on the inner disk in the lower portion thereof, and a piece-recognition device comprising a number of sensors disposed on the path of the alveoles of the outer disk.

Thus, as the two disks are concentric, the piece separation and recognition functions are completely separate while, at the same time, being carried out very swiftly. In addition, this arrangement makes it possible to use a different material for the two disks, namely a metallic material for the inner disk, in order to withstand the impacts caused by the pieces falling in loose condition, and a non-metallic material, such as a plastic material, for the outer disk, so as to ensure that piece detection is not adversely affected.

According to another characteristic of the invention, there is provided a lower recycling device permitting, when two small-sized pieces are lodged in the same alveole in the outer disk, the recycling of the innermost piece towards the inner disk, before it travels past the sensors, this recycling disk being formed by a suitably shaped recess provided in the piece sliding plate.

It is thus possible to separate correctly, in a unitary fashion, all sorts of metallic pieces, including those the diameter of which is smaller than the radius of the largest piece to be processed.

Preferably, there is also provided an upper recycling device permitting the recycling of any piece located in an alveole in the outer disk, towards the inner disk, after it has travelled past the sensors, this upper recycling device being formed by a mobile blade located in prolongation of the sliding plate and controlled by the piece-recognition device, this blade being normally retracted in rest position and presenting, in active position, a guide edge returning the piece to be recycled towards the inner disk.

Thus, a piece having characteristics that do not permit its identification with certainty can be recycled so to be processed again, which makes for a considerable increase in the accuracy of the checking device according to the invention.

The apparatus according to the invention also comprises an automatic flushing device, enabling the cover of the apparatus to be raised in the event of jamming, so as to discharge the pieces or objects that have caused the jamming to a refund cup.

According to another characteristic of the invention, there is provided a device for displaying groups of accepted pieces comprising at least two different types of receptacle for these groups of pieces.

This arrangement makes it possible, for example, to separate tokens from coins in order to guide them towards different boxes.

Preferably, the display device comprises two receptacles of a first type interposed between two receptacles of a second type, which makes it possible to facilitate the subsequent processing of the accepted pieces.

In one particular form of embodiment of the invention, the display device is formed by a scraper having two diametrically opposed limbs, topped by a transparent cover and rotating on an circular inclined plate located substantially in the plane of the two concentric disks, a receptacle of the first type being provided in each of the limbs of the scraper, while the receptacles of the second type are formed by the two sectors located on either side of the scraper.

Furthermore, the display device has a discharge orifice on the side for discharging the pieces located in the receptacles of the first type, and at least one discharge orifice provided in the bottom of the circular plate for discharging the pieces located in the receptacles of the second type.

Preferably, there are provided two separate, contiguous discharge orifices in the circular plate, which makes it possible to guide the pieces towards two different boxes, simply by changing the direction of rotation of the scraper.

According to yet another feature of the invention, there are provided two routing traps placed downstream of the mobile blade of the upper recycling device, these routing traps being controlled by the piece-recognition device so as to guide the accepted pieces towards one or the other of the two types of receptacle of the display device and to guide the non-accepted pieces towards a refund cup.

One form of embodiment of the invention is described herebelow, by way of an example, with reference to the annexed drawings, wherein.

Figure 1:
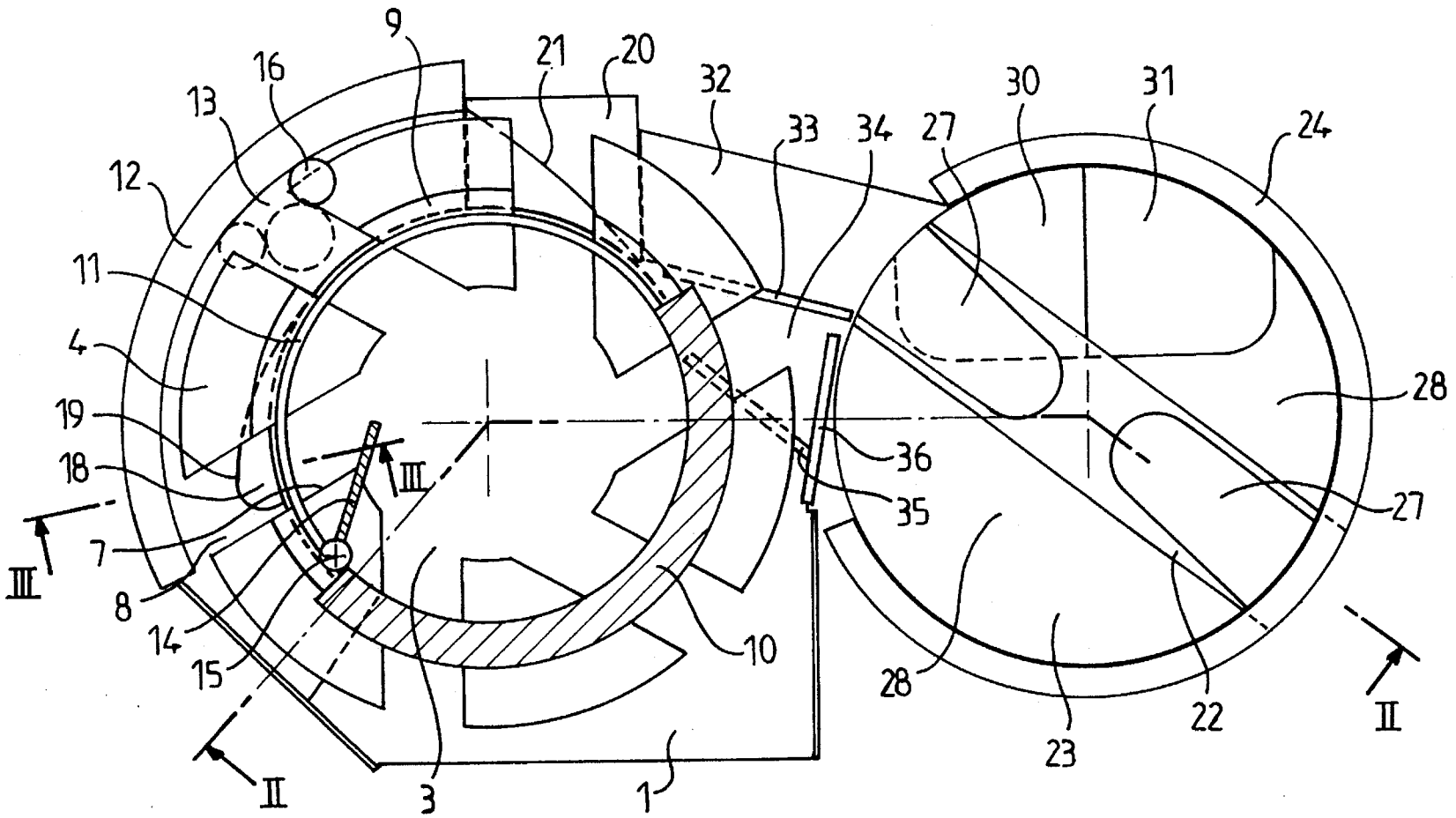
FIG. 1 is a top view of a metallic piece checking device according to the invention, shown without its cover.
Figure 2:
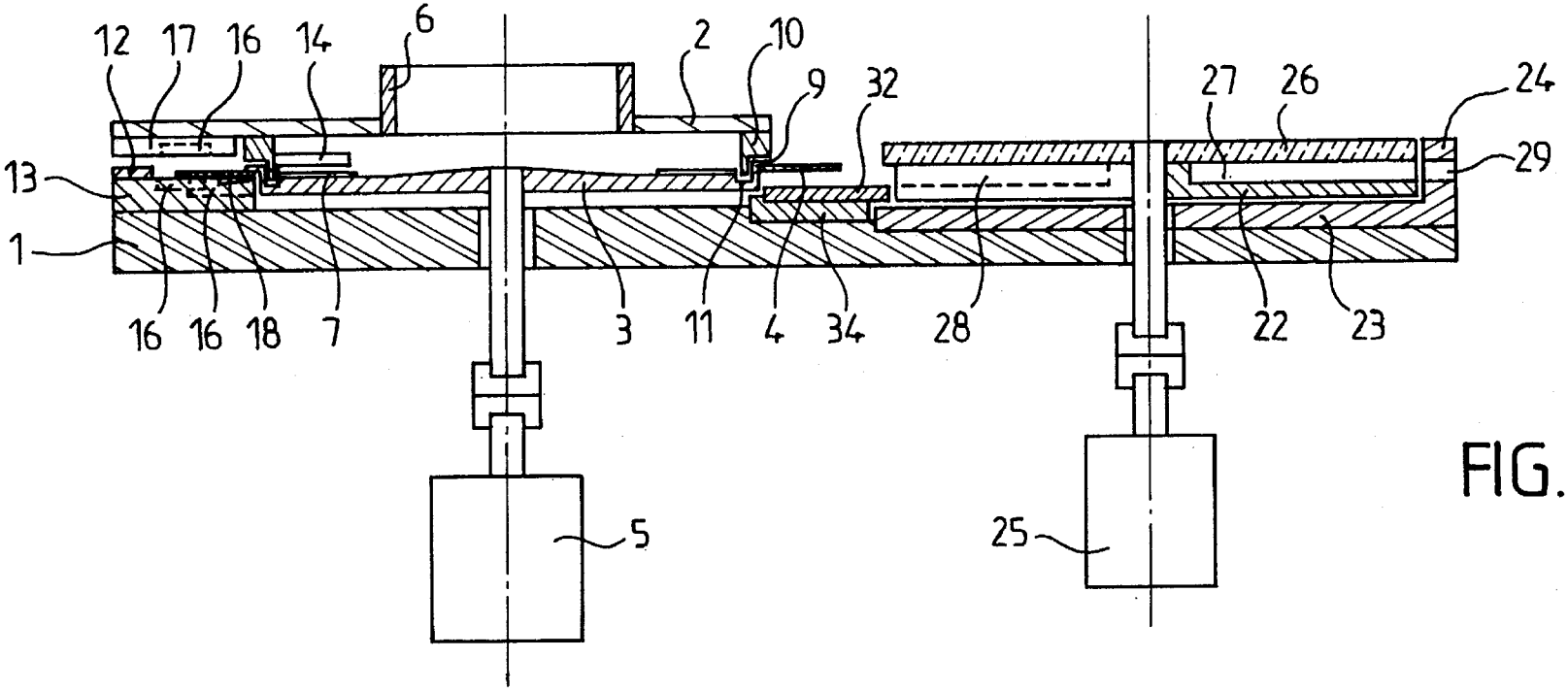
FIG. 2 is a cross-sectional view along line II—II of FIG. 1.

The metallic piece checking device shown in FIGS. 1 and 2 includes first of all a chassis 1 forming an plane inclined at approximately 45° in relation to the horizontal and which is partly covered by a cover 2 connected to the chassis by a hinge, not shown, located on the upper portion. Beneath cover 2 are disposed two integral, concentric disks, namely an inner disk 3 and an outer disk 4, which are driven in rotation in the clockwise direction by means of a motor 5.

The inner disk 3, also referred to as a piece-sorting or separating disk, receives the pieces thrown in loose via a tube 6 fixed to cover 2. This disk is preferably made of metal, in order to withstand the impacts of the pieces, and comprises, for piece separating purposes, a number of substantially radial edges 7, six in this example, regularly distributed at 60° from one another.

Outer disk 4, also termed the piece-detection or recognition disk, is preferably made of a non-metallic material, for example an appropriate plastic material. It is provided, on its periphery, with six open alveoles 8 located in prolongation of the six edges 7 of inner disk 3. This outer disk is, in fact, composed here of the six blades built onto horizontal extensions 9 of the inner disk and thus forming between them the six alveoles 8.

Furthermore, a semi-circular barrier 10, integral with cover 2, is disposed at the separation between inner disk 3 and outer disk 4, in such a way as to cooperate with a groove 11 provided for this purpose in the area of the extensions 9 of the inner disk. This barrier extends over approximately half the circumference of the inner disk and thus retains the pieces to be separated in the lower portion of the sorting disk.

When a piece displaced by an edge 7 of the inner disk escapes from the barrier 10, it is propelled into the corresponding alveole 8 of the outer disk under the effect of centrifugal force. The piece is then pressed against a circular border 12 surrounding the outer disk, while being supported from underneath by a sliding plate 13 fixed to chassis 1 and supporting, at the same time, the said circular border.

The height of each of edges 7 of the sorting disk is such that only one piece can be displaced at a time. However, if, through the effect of number, or in the event of pieces adhering to one another as a result of dirt or moisture, several pieces are displaced at the same time, a thickness-limiting device, also termed a scraper, prevents the uppermost piece or pieces from passing and pushes them back towards the lower portion of the sorting disk. In the particular form of embodiment described here, this scraper is formed by a rigid blade 14 which is mobile in rotation and translation about an pin 15 supported by cover 2.

The piece thus separated being located in an alveole 8 of outer disk 3, it is displaced by the latter as it rotates, and then travels past a piece-recognition device located downstream. This piece-recognition device is essentially composed here of three sensors 16, for example electromagnetic sensors, disposed on the path of the pieces and permitting measurement, in a known manner, of the magnitudes associated, in particular, with the material, the diameter and the thickness of the pieces. Two of these sensors, located below the path, are incorporated in sliding plate 13, while the third is fixed above the path on a support 17 integral with the cover 2. The information provided by these three sensors is then processed in a microprocessor and compared with stored parameters in order to determine whether the piece is accepted or is one that is to be rejected. It will be noted here that electromagnetic detection of the pieces is in no way disturbed by the presence of outer disk 3 since the latter is made of a plastic material.

Figure 3:
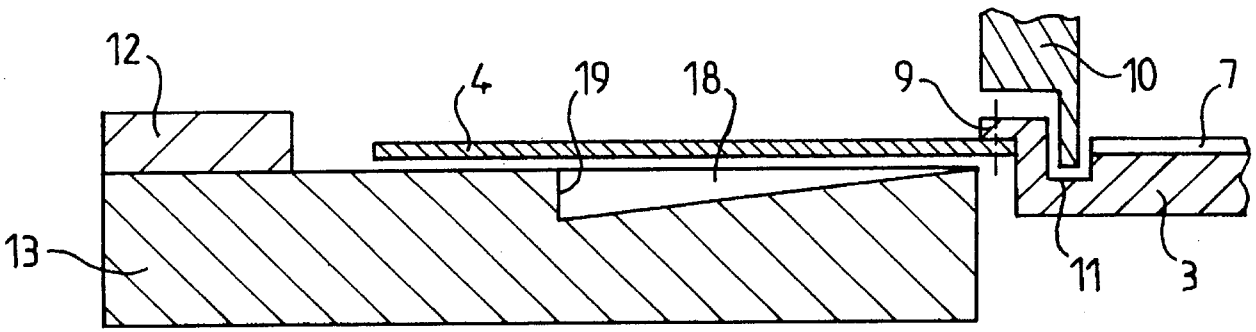
FIG. 3 is a partial cross-sectional view along line III—III of FIG. 1.

Depending on the diameters of the pieces for processing, it may happen that two small pieces are propelled into the same alveole 8 of outer disk 3 and that they cannot, therefore, be recognized. Thickness-limiting device 14 is not, in fact, of any use in this particular case. To solve this problem, the piece checking device according to the invention is equipped with a lower recycling device formed, as more clearly apparent from FIG. 3, by a recess 18 provided in sliding plate 13. This recess 18 forms, outwardly, an edge 19 of a particular shape enabling the innermost piece to be returned onto the sorting disk.

Figure 4:
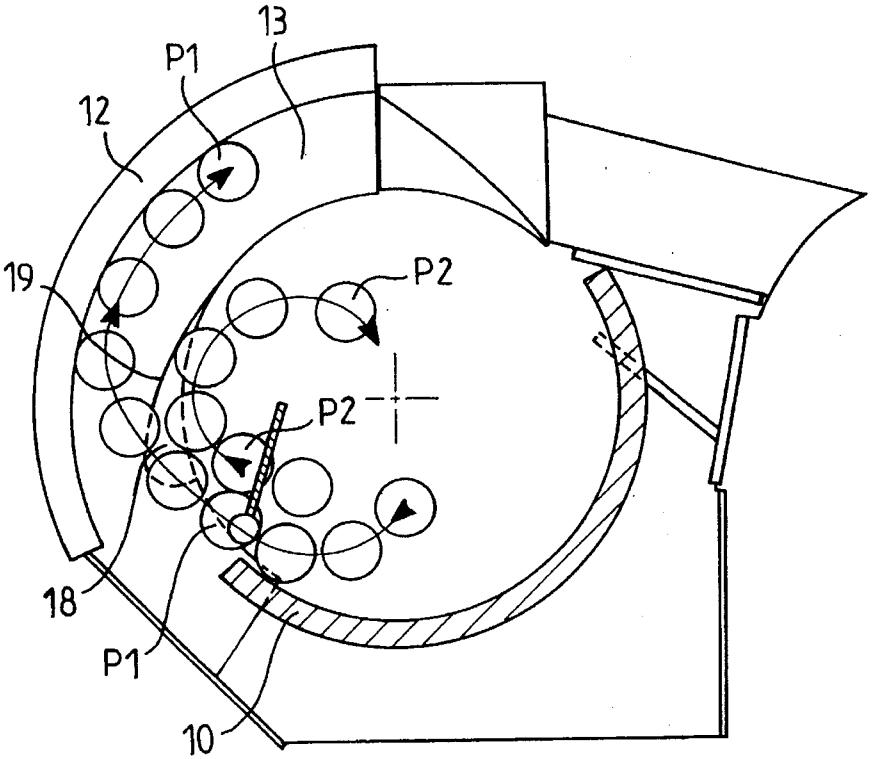

The operation of the lower recycling device is illustrated in FIG. 4. In this figure, we can see that two pieces, P1 and P2, are displaced simultaneously by one and the same edge of the sorting disk. Piece P1 is propelled the first into an alveole in the detecting disk, along a path that does not run over recess 18. It is thus displaced normally by the said alveole towards the electromagnetic sensors 16. On the other hand, innermost piece P2 is propelled in the same alveole of the detecting disk along a path that intersects edge 19 of recess 18. It is then pressed by the force of gravity against the bottom of this recess and compelled to follow the direction imposed by edge 19, which returns it automatically towards the lower portion of the sorting disk with a view to subsequent processing.

The checking device according to the invention is also equipped with an upper recycling device permitting the recycling of pieces which, after travelling past sensors 16, may not have been recognized with sufficient certainty. This upper recycling device is essentially formed by a mobile blade 20 placed in prolongation of sliding plate 13 and comprising a guide edge 21. Blade 20 is actuated by an electromagnet, not shown, controlled by the piece-recognition device and it is returned to rest position by a spring, likewise not shown.

Figure 5:
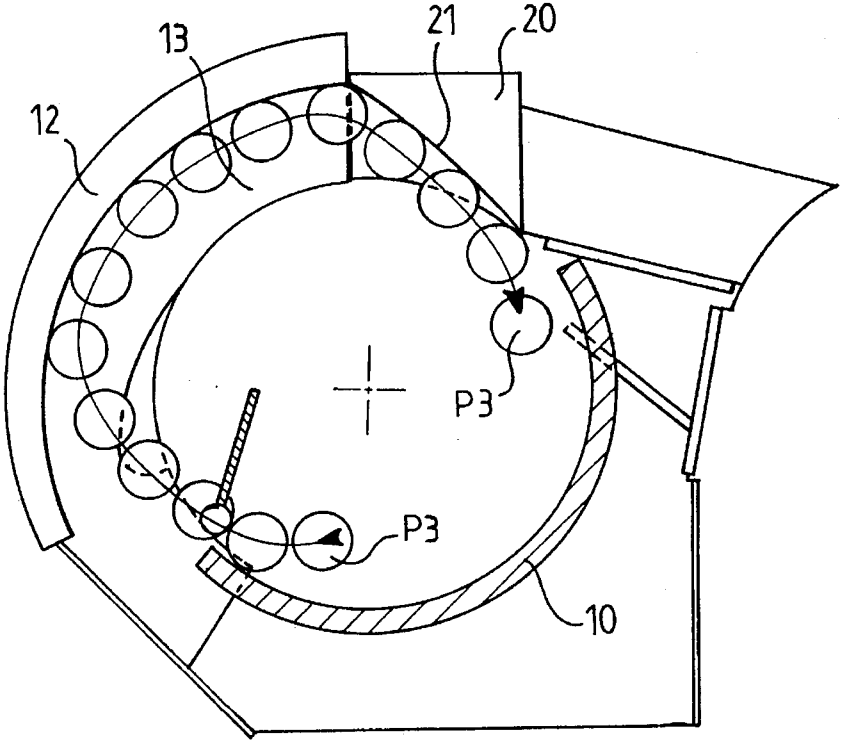
FIGS. 4 to 11 are schematic plan views illustrating the different phases of operation of the checking device according to the invention.

The operation of this upper recycling device is illustrated in FIG. 5, wherein we can see that a piece P3 is displaced along the circular border 12 and over sliding plate 13 by an alveole in the outer disk. When blade 20 is in rest position, it is placed in a plane that is sufficiently below the sliding track for the path of the piece being processed not to be modified. On the hand, when the blade is actuated by the electromagnet, it is placed at the same level as the sliding track and then presents its guide edge 21 which modifies the natural path of piece P3, guiding it inwardly onto the sorting disk. It is thus possible to cause the same piece to travel several times past the different sensors 16, so as to increase the accuracy with which the pieces are recognized.

The checking device according to the invention also comprises an automatic flushing device, known per se, enabling the cover 2 to be raised by means of an electromagnet, not shown. Pieces or objects that have led to jamming are then discharged by gravity feed to a refund cup.

The checking device according to the invention is completed by a device for displaying the groups of accepted pieces, comprising several different receptacles for the pieces, for example coins and tokens. This display device is essentially composed of a scraper 22 with two diametrically opposed limbs, mounted so as to be rotationally mobile on a circular plate 23 parallel to chassis 1 and which is almost completely surrounded by a border 24. The scraper is driven in rotation by means of a motor 25 and it is topped by a transparent cover 26. In each of the limbs of this scraper is provided a compartment 27 allocated, for example, to tokens, while two other compartments 28, allocated, for example, to coins, are formed on either side of the scraper in sectors delimited by circular border 24. An orifice 29 is provided in this circular border 24 to ensure the discharge of the pieces located in compartments 27. As to the pieces located in compartments 28, these are discharged by two contiguous orifices 30 and 31 provided directly in circular plate 23, in the upper portion thereof.

Two routing traps are also provided to ensure that the accepted pieces are guided towards one of the compartments 27 or one of the compartments 28 of the display device.

The first routing trap, enabling the pieces to be guided towards one of compartments 27, is essentially formed by an intermediate sliding plate 32 located in prolongation of blade 20 of the upper recycling device, at a level slightly below that of sliding plate 13. This intermediate sliding plate is barred by a blade 33.

The second routing trap, enabling the pieces to be guided towards one of receptacles 27, is essentially formed by an intermediate sliding place 34 located in prolongation of intermediate sliding plate 32, at a level slightly below that of the latter. This intermediate sliding plate 34 est barred by two blades 35 and 36, integral with one another.

Blades 33 and 35–36 are actuated by means of electromagnets, not shown, controlled by the piece-recognition device and are biased back to rest position by means of springs, likewise not shown. In rest position, blade 33 is flush with intermediate sliding plate 32, and blade 35 is flush with intermediate sliding plate 34, while blade 36 projects, thus constituting an obstacle for the pieces.

In active position, the two blades 33 and 35 project in order to bar the way to the pieces, while blade 36 projects even further and then exposes an opening allowing the pieces to pass underneath.

Figure 6:
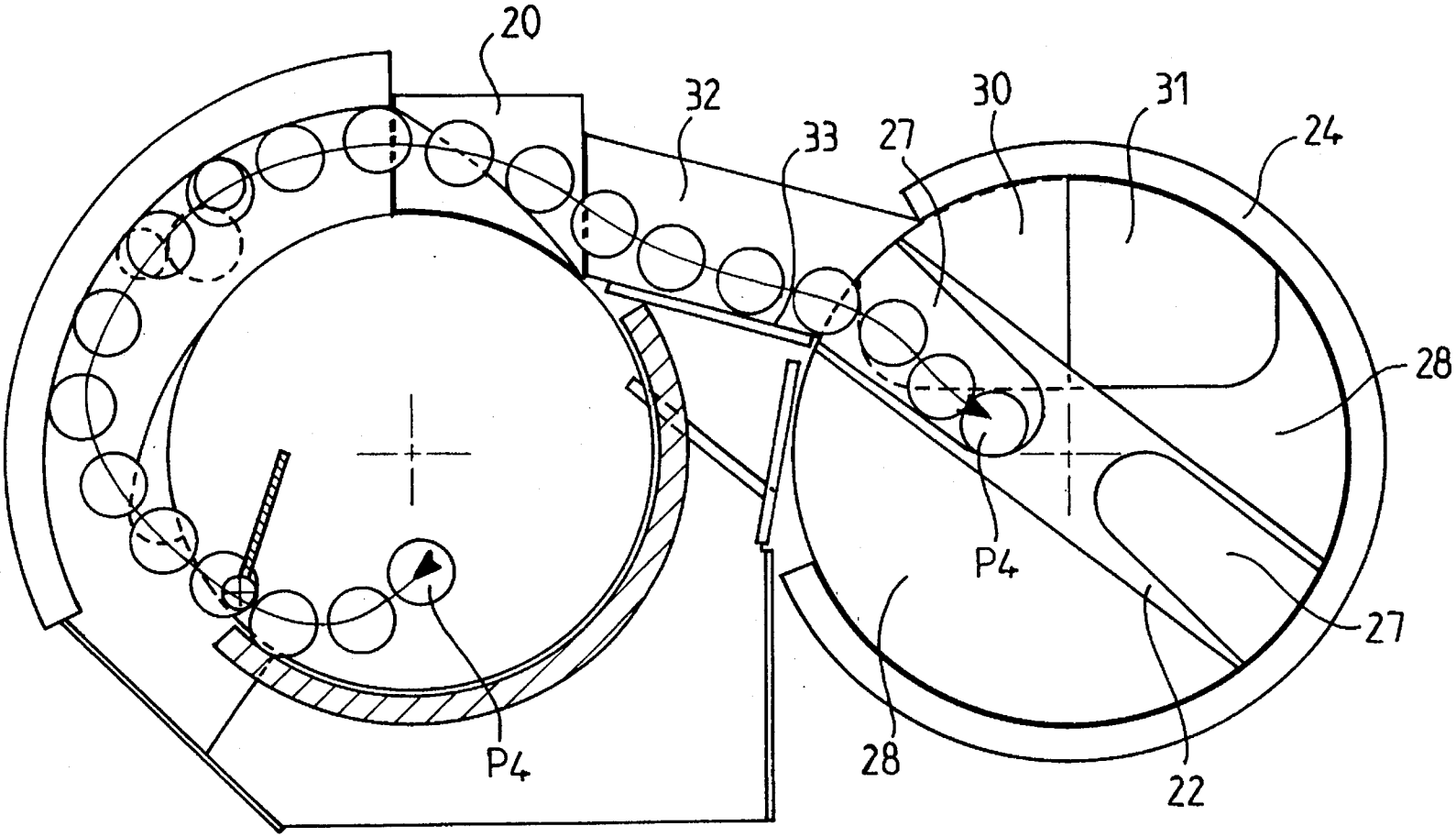
Figure 7:
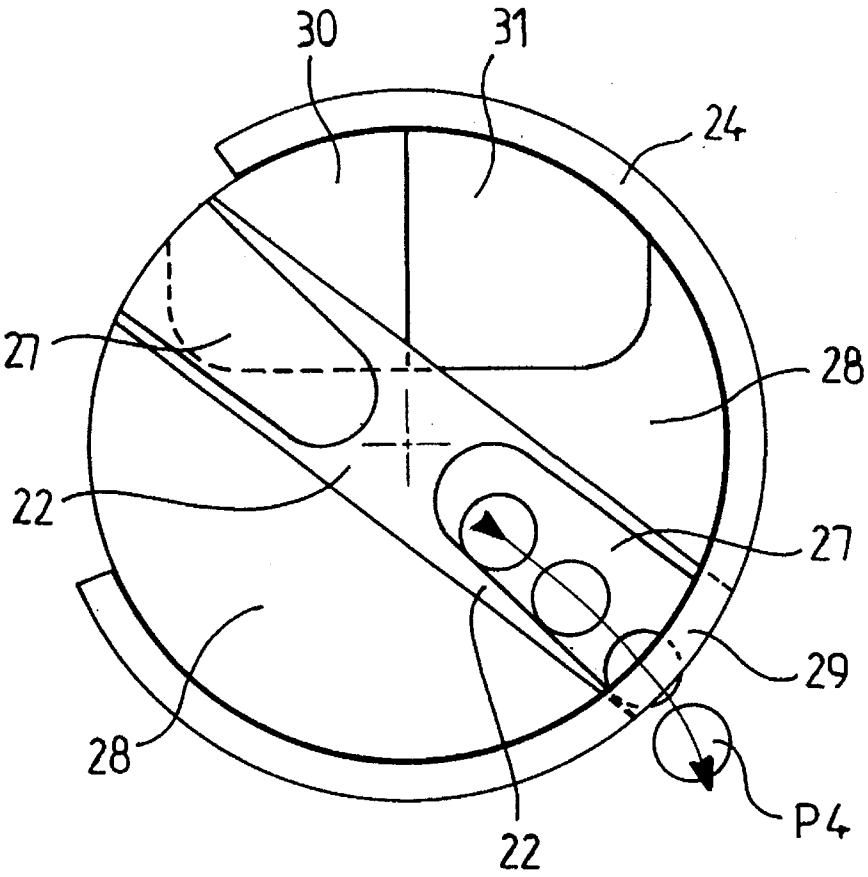

The operation of the first routing system is illustrated in FIG. 6, in which a piece P4 can be seen in the course of processing. The said piece P4, which can be a token, for example, is automatically placed through the effect of gravity on intermediate sliding plate 32. It is then held thereon by blade 33 in active position, which bars its path and compels it to enter compartment 27 of the display device, which is, at this moment, opposite intermediate sliding plate 32. The pieces thus introduced into compartment 27 are then discharged, as illustrated in FIG. 7, after a half turn in one direction or the other by scraper 22, via orifice 29 provided for this purpose in circular border 24, towards a particular box which can advantageously be allocated especially to tokens.

Figure 8:
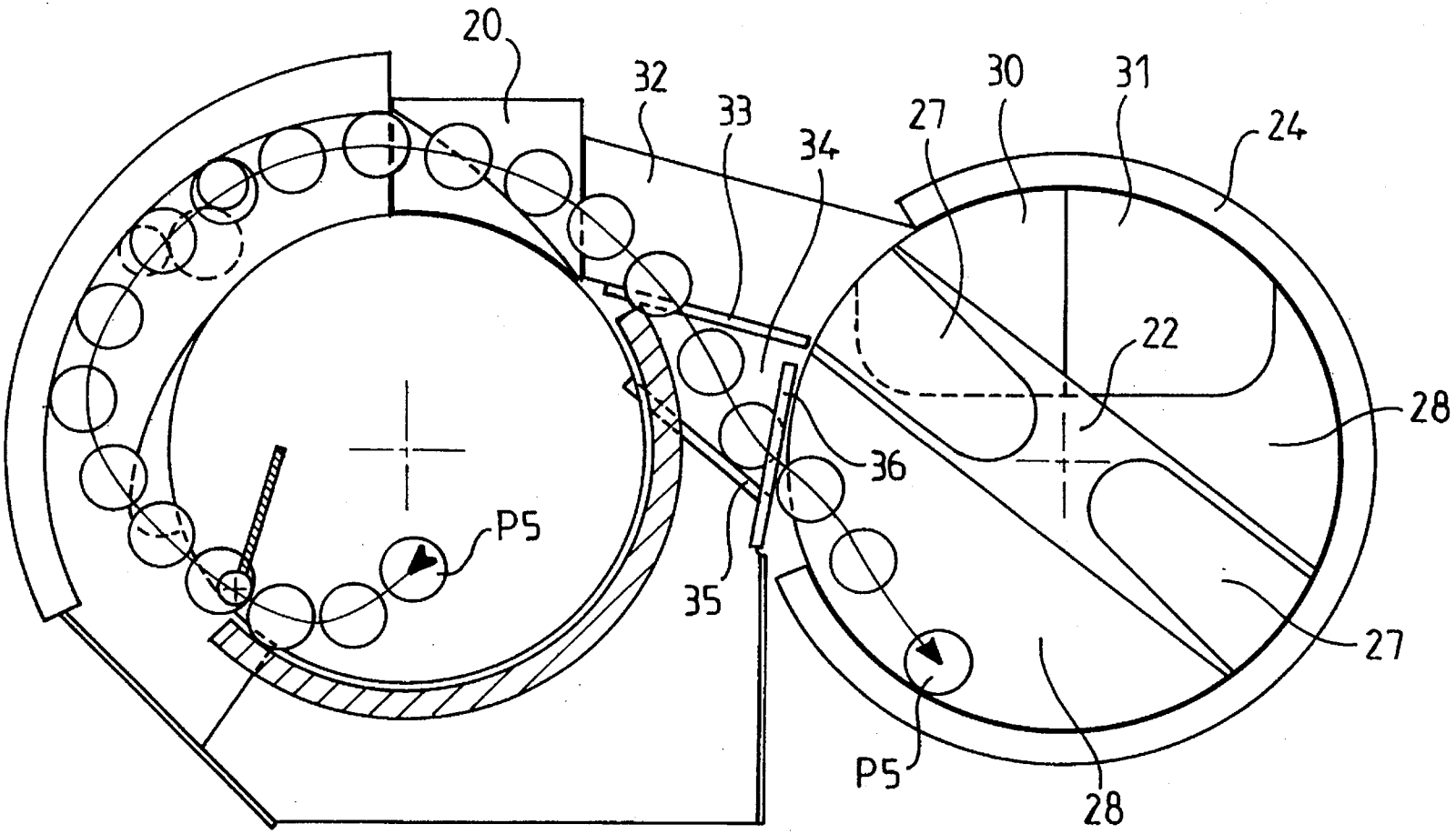

The operation of the second routing system is illustrated in FIG. 8, in which we can see a piece P5 in the course of treatment. This piece P5, a coin for example, is automatically placed by the effect of gravity on intermediate sliding plate 32, and then on intermediate sliding plate 34, following the retraction of blade 33 to rest position. On the other hand, blade 35 is in active position, under the action of its electromagnet controlled by the piece-recognition device, and thus bars the path to the piece undergoing processing. Piece P5 is consequently diverted towards blade 36, which then exposes an opening through which the piece can travel towards compartment 28 of the display device, which is located, at that moment, opposite the said blade 36. It will further be noted that, thanks to transparent cover 26, the operator, as well as the user, can observe the group of pieces thus formed in compartment 28, thus precluding any possibility of disagreement.

Figure 10:
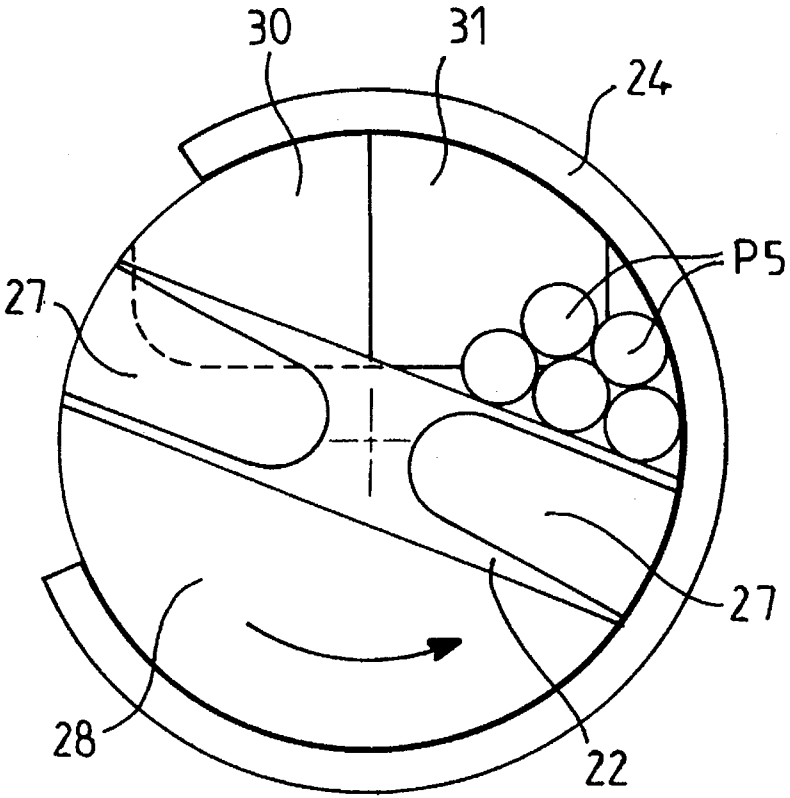
Figure 9:
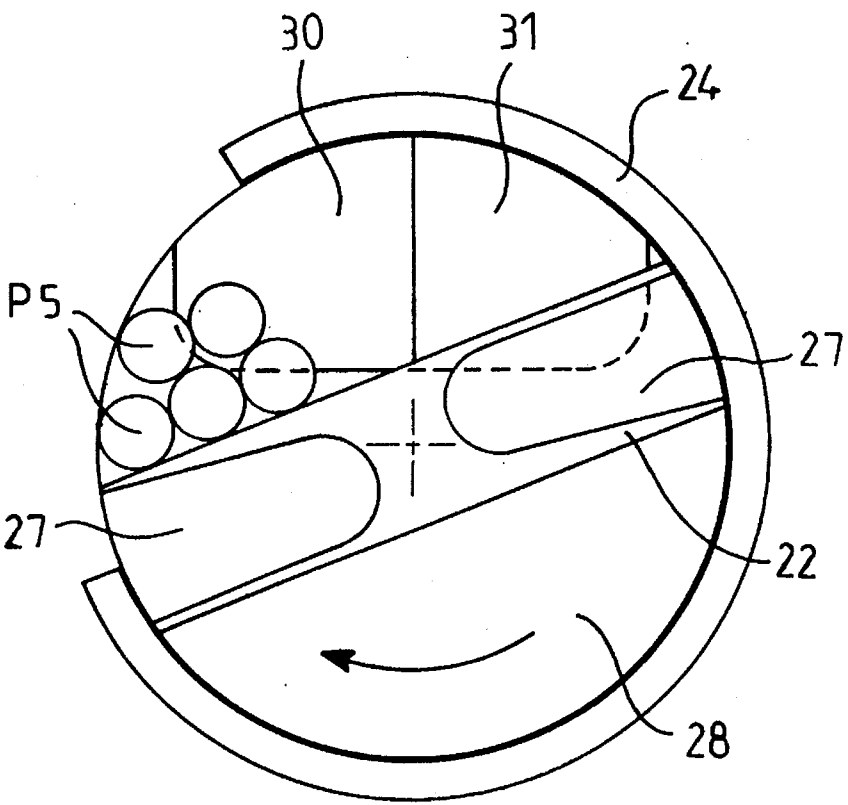

Once payment has been effected and recorded, the group of pieces P5 corresponding to the said payment is discharged, either via orifice 30 to a first box through a clockwise rotation of scraper 22, as illustrated in FIG. 9, or via orifice 31 to a second box, through an anti-clockwise rotation of scraper 22, as illustrated in FIG. 10. This arrangement makes it possible to use, at will, two different boxes allocated to coins, according to requirements.

Figure 11:
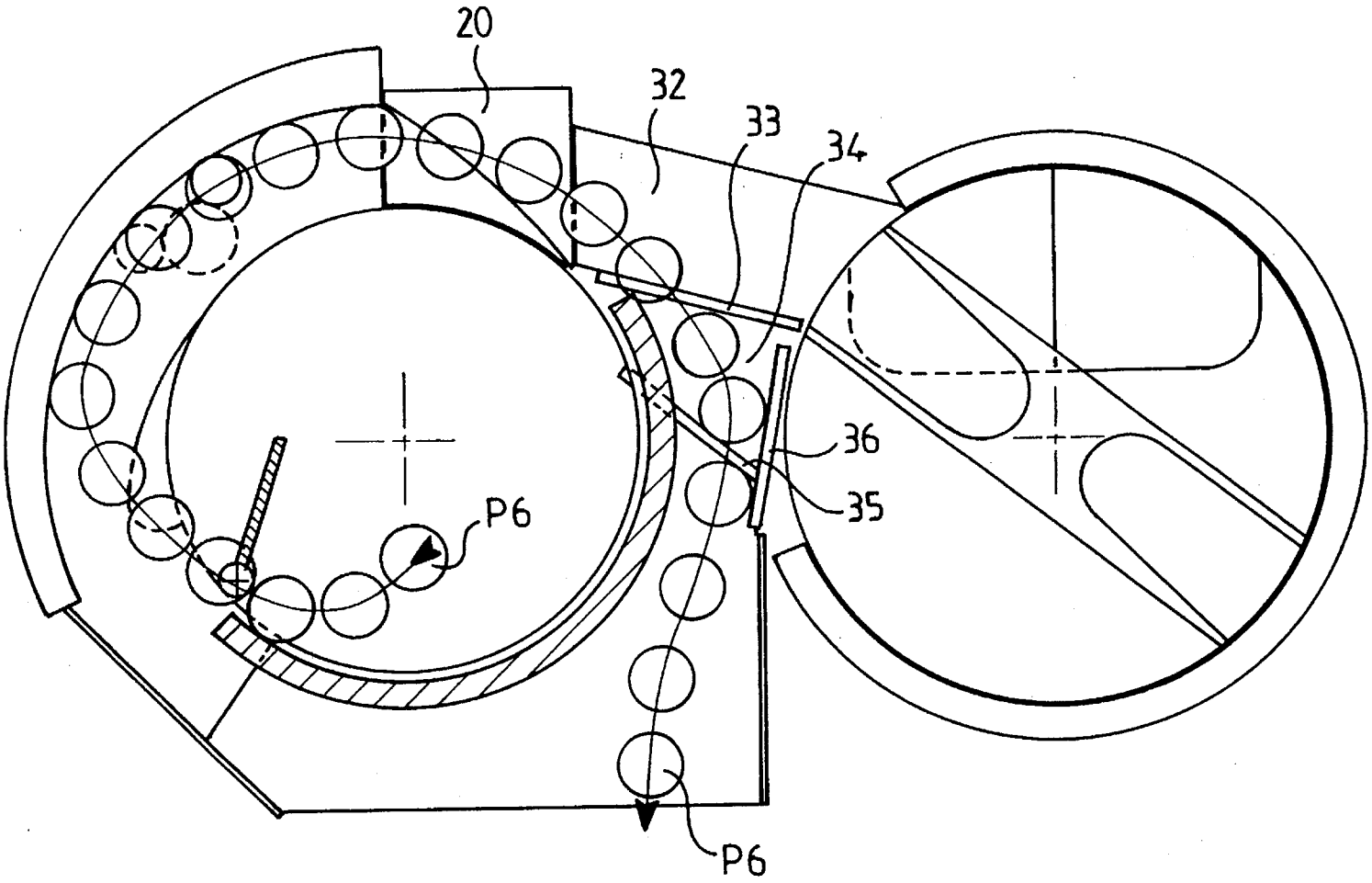

Finally, FIG. 11 illustrates the case of a piece that has not been accepted, for instance a counterfeit coin, or more generally, a foreign object introduced into the apparatus via the entry tube 6. In this case, piece P6 is not recognized by the piece-recognition device when it travels past sensors 16. Consequently, blades 33 and 35–36 remain in rest position. Piece P6 thus continues its route over intermediate sliding plates 32 and 34, its course possibly being deflected by blade 36, and then drops automatically into a refund cup, not shown, provided for this purpose and accessible to the user.

It will thus be appreciated that, in the final analysis, the piece checking device according to the invention exhibits very considerable versatility, while ensuring great reliability and a high operating speed.

We claim:

1. Device for checking metallic pieces, in particular coins, characterized in that it includes:

two motorized, integral, concentric disks (3, 4) rotating in a plane that is inclined in relation to the horizontal, namely:

an internal, so-called separating disk (3), onto which the pieces are thrown in loose condition, and which is provided with substantially radial edges (7) for separating the pieces, and an outer, so-called piece-recognition disk (4), the periphery of which is provided with alveoles (8), located in prolongation of the edges (7) of the internal disk (7), for receiving the pieces thus separated, the said pieces being held in the said alveoles (8) by a sliding plate (13) located under the outer disk (4), and by a circular border (12) partially surrounding the said outer disk (4);

a fixed semi-circular barrier (10) disposed at the separation between the inner disk (3) and the outer disk (4) for retaining the pieces on the inner disk (3) in the lower portion thereof, and a piece-recognition device comprising a number of sensors (16) disposed on the path of the alveoles (8) of the outer disk (4).

2. Checking device according to claim 1, characterized in that the inner disk (3) is made of a metallic material, while the outer disk (4) is made of a non-metallic material.

3. Checking device according to claim 1 or 2, characterized in that it includes a lower recycling device permitting, when two small-sized pieces are lodged in the same alveole (8) in the outer disk (4), the recycling of the innermost piece towards the inner disk (3), before it travels past the sensors (16), this recycling disk being formed by a suitably shaped recess (18) provided in the piece sliding plate (16).

4. Checking device according claim 1, characterized in that it further includes an upper recycling device permitting the recycling of any piece located in an alveole (8) in the outer disk (4), towards the inner disk (3), after it has travelled past the sensors (16), this upper recycling device being formed by a mobile blade (20) located in prolongation of the sliding plate (13) and controlled by the piece-recognition device, this blade (20) being normally retracted in rest position and presenting, in active position, a guide edge (21) returning the piece to be recycled towards the inner disk (3).

5. Checking device according to claim 4, characterized in that it further includes a device for displaying the groups of accepted pieces comprising at least two different types of receptacle (27, 28) for these groups of pieces.

6. Checking device according to claim 5, characterized in that the display device comprises two receptacles (27) of a first type interposed between two receptacles (28) of a second type.

7. Checking device according to claim 6, characterized in that the display device is formed by a scraper (22) having two diametrically opposed limbs, topped by a transparent cover (26) and rotating on an circular inclined plate (23) located substantially in the plane of the two concentric disks (3, 4), a receptacle (27) of the first type being provided in each of the limbs of the scraper (22), while the receptacles (22) of the second type are formed by the two sectors located on either side of the scraper (22).

8. Checking device according to claim 7, characterized in that the display device has a discharge orifice (29) on the side for discharging the pieces located in the receptacles (27) of the first type, and at least one discharge orifice (30, 31) provided in the bottom of the circular plate (23) for discharging the pieces located in the receptacles (28) of the second type.

9. Checking device according to claim 8, characterized in that there are provided two separate, contiguous discharge orifices (30, 31) in the circular plate (23), the use of these two orifices being selected by the direction of rotation of the scraper (22).

10. Checking device according to claim 5, characterized in that it further includes two routing traps (32, 33, 34, 35, 36) placed downstream of the mobile blade (20) of the upper recycling device, these routing traps being controlled by the piece-recognition device so as to guide the accepted pieces towards one or the other of the two types of receptacle (27, 28) of the display device and to guide the non-accepted pieces towards a refund cup.

* * * * *